US009008524B2

(12) United States Patent
Mamiya et al.

(10) Patent No.: US 9,008,524 B2
(45) Date of Patent: Apr. 14, 2015

(54) IMAGE FORMING DEVICE HAVING A TONER SUPPLY CONTROL PORTION

(71) Applicant: Konica Minolta, Inc., Tokyo (JP)

(72) Inventors: Yusuke Mamiya, Nagoya (JP); Soh Hirota, Toyokawa (JP); Hironori Akashi, Okazaki (JP); Yoshinori Tsutsumi, Toyokawa (JP); Kanako Kibihara, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/907,594

(22) Filed: May 31, 2013

(65) Prior Publication Data

US 2013/0322896 A1 Dec. 5, 2013

(30) Foreign Application Priority Data

Jun. 1, 2012 (JP) ..... 2012-125954

(51) Int. Cl.
*G03G 15/08* (2006.01)
*G03G 15/09* (2006.01)
*G03G 15/00* (2006.01)

(52) U.S. Cl.
CPC ..... *G03G 15/0824* (2013.01); *G03G 15/09* (2013.01); *G03G 15/0849* (2013.01); *G03G 15/0893* (2013.01); *G03G 15/556* (2013.01)

(58) Field of Classification Search
USPC ..... 399/27, 53
See application file for complete search history.

(56) References Cited

U.S. PATENT DOCUMENTS

| | | | | |
|---|---|---|---|---|
| 7,783,215 | B2 * | 8/2010 | Tanaka | 399/62 |
| 2008/0232858 | A1 * | 9/2008 | Uematsu | 399/254 |
| 2012/0207488 | A1 * | 8/2012 | Stelter et al. | 399/27 |

FOREIGN PATENT DOCUMENTS

| | | |
|---|---|---|
| JP | 2005-091651 | 4/2005 |
| JP | 2008-268881 | 11/2008 |

* cited by examiner

*Primary Examiner* — Quana M Grainger
(74) *Attorney, Agent, or Firm* — Lucas & Mercanti, LLP

(57) ABSTRACT

For each of N imaginary regions divided at predetermined intervals in the direction of the rotation shaft of a developer roller (12), the amount of toner consumed when an image is formed is previously calculated. Then, the same amount of toner as a toner consumption amount calculated for each imaginary region is supplied to a development device (2) earlier by a time in which the toner supplied from a toner hopper (5) is transported to each imaginary region than at the time of the development. Thus, it is possible to maintain a toner concentration within the development device within a predetermined range without the toner being dispersed and an image formation speed being reduced even if an image having a high print rate is formed.

5 Claims, 12 Drawing Sheets

IMAGE FORMING DEVICE HAVING A TONER SUPPLY CONTROL PORTION

This application is based on Japanese Patent Application No. 2012-125954 filed on Jun. 1, 2012 the contents of which are hereby incorporated by reference.

BACKGROUND OF THE INVENTION

1. Field of the Invention

The present invention relates to an image forming device, and more particularly to an image forming device that uses a two-component developer containing a toner and a carrier.

2. Description of the Related Art

In an image forming device using an electrophotographic system such as a facsimile, a printer or a copying machine, an electrostatic latent image formed on the surface of a photosensitive member that serves as an electrostatic latent image carrying member is visualized by a developer, and the visualized image is transferred to a recording member such as a sheet and is thereafter fixed by heating and pressurizing. As the developer used here, a two-component developer containing a toner and a carrier is widely used in terms of high-quality and colorization.

In the development using the two-component developer, a developer carrying member incorporating a plurality of magnetic poles and carrying the developer on its surface is arranged apart and opposite the photosensitive member, in a region (development region) where the developer carrying member and the photosensitive member are opposite each other, a magnetic brush where the carrier is collected to rise is formed, a development bias voltage is applied between the developer carrying member and the photosensitive member to adhere the toner to the electrostatic latent image on the surface of the photosensitive member and thus the development is performed. Then, toner corresponding to the toner consumed in the development is sequentially supplied from a toner hopper to a development device, and thus the concentration of the toner within the development device is maintained within a predetermined range.

However, when an image, such as a solid image, having a high print rate is formed, a large amount of toner is consumed to greatly reduce the toner concentration around the developer carrying member, and thus it takes a long time to restore the toner concentration by the supply of the toner. In particular, in the case of long paper that is long in the direction in which a recording member is transported, it takes a long time to restore the toner concentration.

Hence, for example, patent document 1 (Japanese Unexamined Patent Application Publication No. 2005-91651) discloses that, when images are continuously formed on a plurality of sheets, even if a time for agitating a developer suitable for an interval between sheets of paper is adjusted according to the size of the sheet and the images are continuously formed on the sheets of long paper, the image quality is prevented from being reduced.

Moreover, patent document 2 (Japanese Unexamined Patent Application Publication No. 2008-268881) discloses a development device that includes: a developer supply portion (11a) provided in the developer supply position of a circulation transport room (3+4) where the developer is circularly transported; a developer consumption amount calculation unit for calculating the consumption amount of developer in a plurality of accumulative consumption amount calculation regions (A1 to A15) obtained by dividing the circulation transport room (3+4); a consumption amount transfer unit for transferring the consumption amount in each of the accumulative consumption amount calculation regions (A1 to A15) to the accumulative consumption amount calculation region (A1 to A15) on the downstream side in the developer transport direction according to the transport of the developer by a circulation transport member (7+8); a supply amount setting unit for setting a supply amount based on the consumption amount in the accumulative consumption amount calculation region (A1) corresponding to the developer supply position; and a developer supply control unit for controlling the supply of the developer based on the supply amount that has been set.

However, in the method disclosed in patent document 1, an image formation speed is likely to be reduced. Moreover, in the method disclosed in patent document 2, toner corresponding to the toner consumed, calculated from the number of pixels, is supplied later, and, when images having a high print rate are continuously formed on long paper, the toner concentration is significantly reduced at the back end of the sheet and on the downstream side in the transport direction of the developer in the direction of a developer roller shaft, with the result that the concentration is reduced.

The present invention is made in view of the conventional problems described above; an object of the present invention is to provide an image forming device that can maintain a toner concentration within a development device within a predetermined range without the toner being dispersed and an image formation speed being reduced even if an image having a high print rate is formed.

SUMMARY OF THE INVENTION

To achieve the above object, according to the present invention, there is provided an image forming device that develops, with a toner, an electrostatic latent image formed on an image carrying member based on image information and that transfers a developed toner image to a recording member to form the image on the recording member, the image forming device including: a developer carrying member that carries a developer containing the toner and a carrier on a surface, and that rotates and transports the developer to a position opposite the image carrying member to develop, with the toner, the electrostatic latent image formed on the image carrying member; a development device that includes the developer carrying member and a developer transport unit which transports, while agitating and mixing the developer, the developer to feed the developer to the developer carrying member; a toner storage portion that stores the toner which is supplied to a transport region of developer transport unit of the development device; a calculation unit that calculates, per image formation operation, from the image information, an amount of the toner consumed when the image is formed, for each of a plurality of imaginary regions divided at predetermined intervals in a direction of a rotation shaft of the developer carrying member; and a toner supply control portion that controls an amount of the toner supplied from the toner storage portion to the development device and supply timing, where the toner supply control portion supplies, to the development device, the same amount of the toner as the amount of the toner consumed in each of the imaginary regions when the development is performed that is calculated by the calculation unit, earlier by a time in which the toner supplied from the toner storage portion is transported to each of imaginary regions than at the time of the development.

Here, preferably, an image forming control portion that controls timing at which the image formation is performed is further included, and, if the image forming control portion determines that, when the image formation is performed based on the acquired image information, the time when the development is performed with the toner in each imaginary region is ahead of the time when the toner supplied from the toner storage portion is transported to each imaginary region, the image forming control portion performs control such that the time when the image formation is started is delayed to make the time when the development is performed with the toner equal to the time when the toner supplied from the toner storage portion is transported to each imaginary region.

Moreover, preferably, the image forming control portion that controls timing at which the image formation is performed is further included, the toner supply control portion acquires, from the image forming control portion, the time when the electrostatic latent image formed on the image carrying member by the developer carrying member is developed with the toner, and toner supply with timing at which the toner cannot be supplied to the development device, due to the acquired time described above, earlier by a time in which the toner supplied from the toner storage portion is transported to each imaginary region than at the time of development is suspended.

Here, the image forming control portion that controls timing at which the image formation is performed is included; when the image formation is continuously performed on a plurality of recording members based on the image information, the toner supply control portion acquires, from the image forming control portion, the time when the electrostatic latent image formed on the image carrying member per image formation operation by the developer carrying member is developed with the toner; whether or not timing at which the toner supplied from the toner storage portion cannot be supplied to the development device, due to the acquired time described above, earlier by a time in which the toner supplied from the toner storage portion is transported to each imaginary region than at the time of development is made is determined per image formation operation; toner supply with timing at which the toner cannot be supplied to the development device earlier by a time in which the toner supplied from the toner storage portion is transported to each imaginary region than at the time of development is suspended.

The toner supply control portion performs the suspended toner supply so as not to exceed a previously set upper limit supply amount per unit time.

Effects of the Invention

In the image forming device of the present invention, for each of a plurality of imaginary regions divided at predetermined intervals in the direction of the rotation shaft of a developer carrying member, the amount of toner consumed when an image is formed is previously calculated, and the amount of toner calculated for each imaginary region is supplied to a development unit earlier by a time in which the toner supplied from a toner storage portion is transported to each imaginary region than at the time of the development, with the result that it is possible to prevent the reduction in image density caused by reduction of the toner concentration within the development unit and the dispersion of the toner caused by the supply of excessive toner.

DESCRIPTION OF PREFERRED EMBODIMENTS

An image forming device according to the present invention will be described in further detail below with reference to accompanying drawings; the present invention is not limited to these embodiments.

Figure 1:
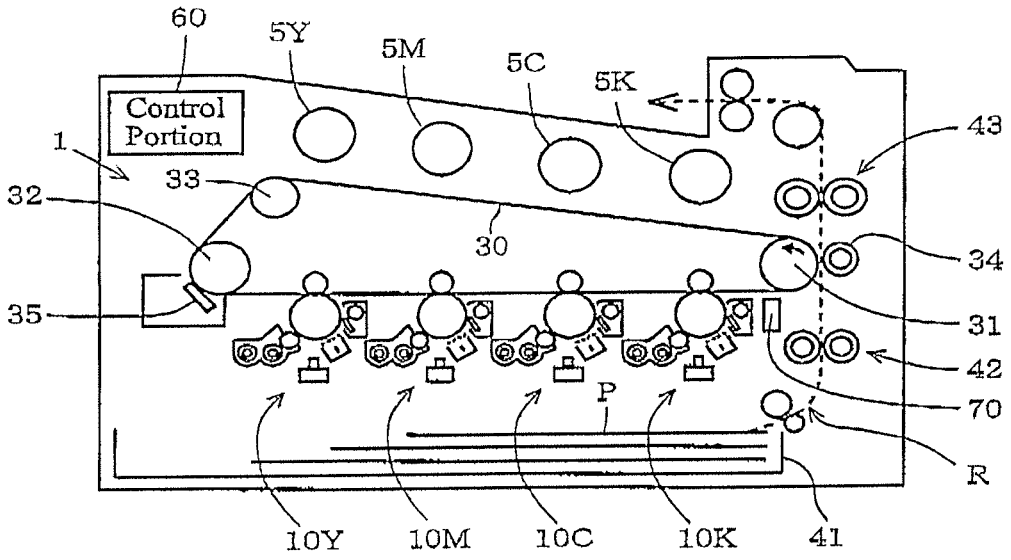
FIG. 1 A schematic diagram showing an example of an image forming device according to the present invention.

FIG. 1 is a schematic diagram of a so-called tandem color printer showing an example of the image forming device according to the present invention. An image forming portion 1 shown in the figure includes a seamless intermediate transfer belt 30 having conductivity, an image formation unit 10 and an exposure device 13. The intermediate transfer belt 30 is placed over rollers 31, 32 and 33 in a tensioned state. The roller 31 is coupled to an unillustrated motor, the roller 31 is rotated counterclockwise by the drive of the motor and thus the intermediate transfer belt 30 and the rollers 32 and 33 in contact therewith are rotated accordingly. The roller 33 applies, with an unillustrated force application unit, a force acting outwardly to the intermediate transfer belt 30, and thus a tension is applied to the intermediate transfer belt 30. On the outside of a belt portion supported by the roller 31, a secondary transfer roller 34 is pressed. In a nip portion (secondary transfer region) between the secondary transfer roller 34 and the intermediate transfer belt 30, a toner image formed on the intermediate transfer belt 30 is transferred to a sheet P that has been transported.

On the outside of the belt portion supported by the roller 32, a belt cleaning blade 35 that cleans the surface of the intermediate transfer belt 30 is provided. The belt cleaning blade 35 is pressed onto the roller 32 through the intermediate transfer belt 30, and removes and collects, at a contact portion with the intermediate transfer belt 30, the residual toner that has not been transferred.

On the lower side of the intermediate transfer belt 30, sequentially from the upstream side in the direction of rotation of the intermediate transfer belt 30, four image formation units 10Y, 10M, 10C and 10K (hereinafter also collectively referred to as the "image formation unit 10") of yellow (Y), magenta (M), cyan (C) and black (K) are arranged such that they are removable from a device main body 1. In these image formation units 10, the developers of the individual colors are used to form the toner images of the corresponding colors.

Moreover, between the image formation unit 10K and the secondary transfer roller 34, an optical concentration detection sensor 70 is arranged opposite the intermediate transfer belt 30. The amount of toner attached to the patch image of each color formed on the intermediate transfer belt 30 by the image formation unit 10 is detected with the concentration detection sensor 70, and thus image formation conditions in the image formation unit 10 and the toner concentration in a development device 2 are adjusted.

Figure 2:
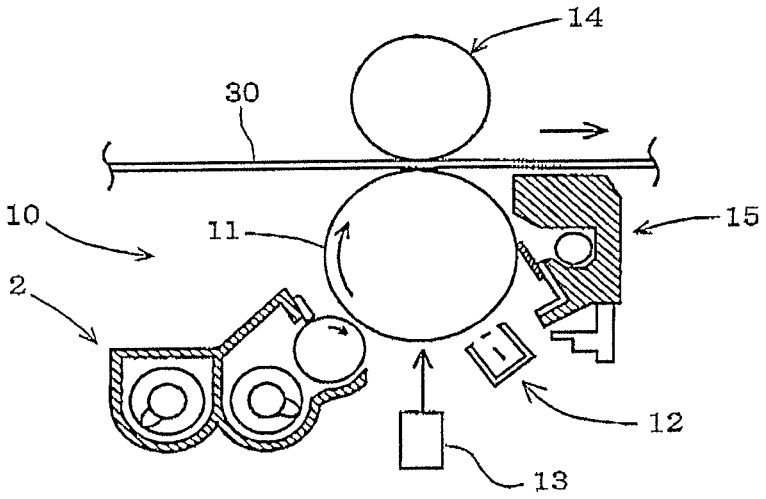
FIG. 2 A schematic diagram of an image forming unit.

Toner hoppers (toner storage portions) 5Y, 5M, 5C and 5K (hereinafter also collectively referred to as a "toner hopper 5") that supply the toners of the individual colors are provided according to the individual image formation units 10; from here through an unillustrated joint, the toner is supplied to each development device 2 (which is shown in FIG. 2).

FIG. 2 shows a schematic diagram of the image formation unit 10. The image formation unit 10 includes a cylindrical photosensitive member 11 serving as an electrostatic latent image carrying member. Around the photosensitive member 11, sequentially along the direction of rotation thereof (the clockwise direction), a charging device 12, an exposure device 13, a development device 2, a primary transfer roller 14 and a cleaning device 15 are arranged. The primary transfer roller 14 is pressed to the photosensitive member 11 through the intermediate transfer belt 30 to form a nip portion (a primary transfer region).

As shown in FIG. 1, below the image formation unit 10, a paper feed cassette 41 is removably arranged as a paper feed device. Sheets P stacked and stored within the paper feed cassette 41 are fed out to a transport path R, sequentially from the uppermost sheet, one-by-one, by the rotation of a paper feed roller arranged near the paper feed cassette 41. The sheet P fed out from the paper feed cassette 41 is transported to a register roller pair 42 where the sheet P is fed out to a secondary transfer region with predetermined timing.

The image forming device can switch between a monochrome mode where a monochrome image is formed with the toner of one color (for example, black) and a color mode where a color image is formed with the toners of four colors.

An example of the image formation operation in the color mode will be briefly described. First, in each image formation unit 10, the outer circumferential surface of the photosensitive member 11 rotated and driven at a predetermined circumferential velocity is charged by the charging device 12. Then, light corresponding to image information is projected from the exposure device 13 onto the surface of the charged photosensitive member 11 to form an electrostatic latent image. Then, this electrostatic latent image is made to appear by the toner that is fed as the developer from the development device 2. In this way, the toner images of the individual colors formed on the surface of the photosensitive member 11 reach the primary transfer region by the rotation of the photosensitive member 11, and are then transferred (primarily transferred) from the photosensitive member 11 onto the intermediate transfer belt 30 in the following order: yellow, magenta, cyan and black, and they are overlaid on each other.

The residual toner left on the photosensitive member 11 without being transferred to the intermediate transfer belt 30 is scraped off with the cleaning device 15, and is removed from the outer circumferential surface of the photosensitive member 11.

The overlaid toner images of the four colors are transported to the secondary transfer region by the intermediate transfer belt 30. On the other hand, the sheet P is transported from the register roller pair 42 to the secondary transfer region so as to correspond to such timing. Then, in the secondary transfer region, the toner images of the four colors are transferred (secondarily transferred) from the intermediate transfer belt 30 to the sheet P. The sheet P to which the toner images of the four colors have been transferred is transported to a fixing roller pair 43. In the fixing roller pair 43, the sheet P passes through the nip portion between a fixing roller and a pressurization roller. In the meantime, the sheet P is heated and pressurized, and the toner images on the sheet P are fused and fixed to the sheet P. The sheet P to which the toner images have been fixed is ejected by an ejection roller pair to a paper ejection tray.

On the other hand, the residual toner left on the intermediate transfer belt 30 without being transferred to the sheet P is scraped off with the cleaning blade 35, and is removed from the outer circumferential surface of the intermediate transfer belt 30. Thereafter, the rotation and driving of each photosensitive member 11 and the intermediate transfer belt 30 are stopped.

Figure 3:
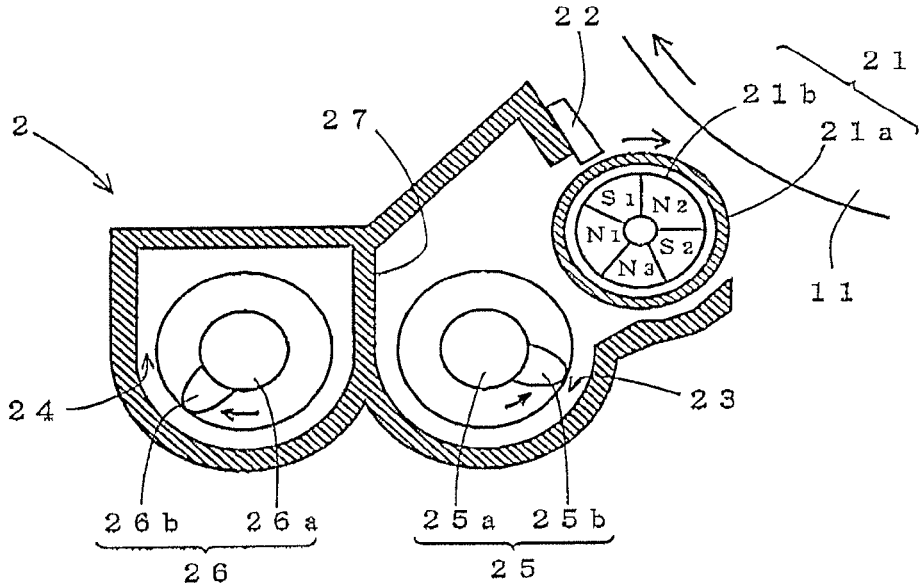
FIG. 3 A vertical cross-sectional view of a development device.
Figure 4:
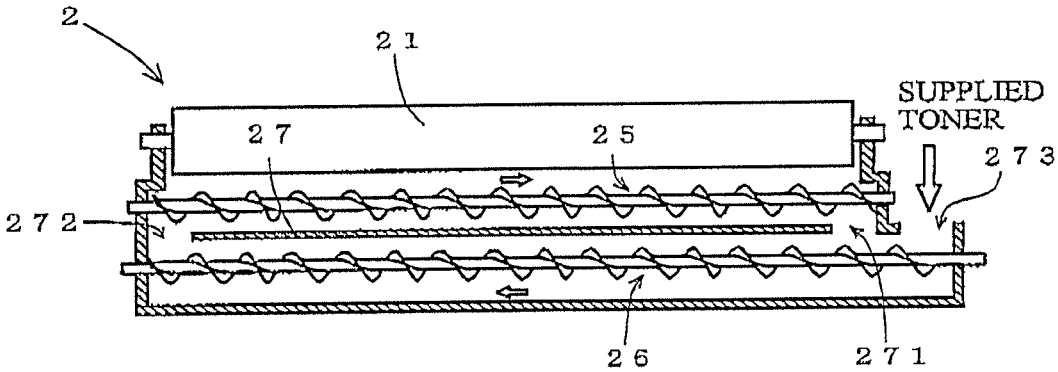
FIG. 4 A horizontal cross-sectional view of the development device.

FIGS. 3 and 4 respectively show a vertical cross-sectional view and a horizontal cross-sectional view of the development device 2. The development device 2 shown in these figures uses a two-component developer having a carrier formed with magnetic particles and the toner to form the electrostatic latent image on the photosensitive member 11. The development device 2 described above includes: a freely rotating development roller (developer carrying member) 21; a plate-shaped regulation member 22 that regulates the amount of developer transported to a development portion; a first transport path 23 that is formed along the development roller 21; a second transport path 24 that is formed through a partition plate 27 parallel to the first transport path 23; and a first transport member 25 and a second transport member 26 that are arranged in the first transport path 23 and the second transport path 24. In both end portions of the partition plate 27 in the longitudinal direction, opening portions 271 and 272 (shown in FIG. 4) are formed, and the first transport path 23 and the second transport path 24 communicate with each other in both end portions in the longitudinal direction. Since the supply toner from the toner hopper 5 (shown in FIG. 1) needs to be charged up to a predetermined charging amount by agitation and mixing, the supply toner is fed from an opening portion 273 (shown in FIG. 4) formed in the upstream end of the second transport member 26 in the developer transport direction.

The mixing ratio between the toner and the carrier of the developer is adjusted such that it is possible to obtain a desired toner charging amount. The toner proportion in the developer is, with respect to the total amount of the toner and the carrier, preferably 3 to 30 mass percent and is more preferably 5 to 9 mass percent.

The development roller 21 includes: a tube-shaped member 21*a* that is rotated clockwise in the figure by an unillustrated drive mechanism; and a magnetic field generation unit 21*b* that is provided within the tube-shaped member 21*a* and that is formed with a plurality of magnetic poles. The individual magnetic poles constituting the magnetic field generation unit 21*b* individually function as follows. The magnetic pole (drawing-up pole) $N_1$ functions to draw up the developer to the tube-shaped member 21*a*. The magnetic pole $S_1$ functions to control, along with the regulation member 22, the amount of developer transported to the development portion. The magnetic pole $N_2$ functions to make the developer rise in the shape of a brush to develop, with the toner, the electrostatic latent image on the surface of the photosensitive member 11. The magnetic pole $S_2$ functions to transport the developer into the development device. The magnetic pole $N_3$ functions to transport the developer into the development device 2 and to separate the developer from the tube-shaped member 21*a* with a repulsive magnetic field generated between the magnetic pole $N_3$ and the adjacent magnetic pole $N_1$ and to return it to the agitation portion of the first transport member 25.

In the first transport member 25 and the second transport member 26, spiral blades 25*b* and 26*b* are provided on the outer circumference of shaft members 25*a* and 26*a*; they are rotated in opposite directions by an unillustrated drive mechanism. The developer is transported, while agitated, in the rightward direction of FIG. 4 by the rotation of the first transport member 25; the developer is transported, while agitated, in the leftward direction of FIG. 4 by the rotation of the second transport member 26. Then, in both end portions of the first transport member 25 and the second transport member 26, through the opening portions 271 and 272 formed in both end portions of the partition plate 27, the developer is moved from one transport member to the other transport member. In this way, the developer is circulated within a circulation path formed in the first transport path 23 and the second transport path 24 and is agitated. The toner is charged up to a predetermined value by being circulated while agitated within the development device 2.

Figure 5:
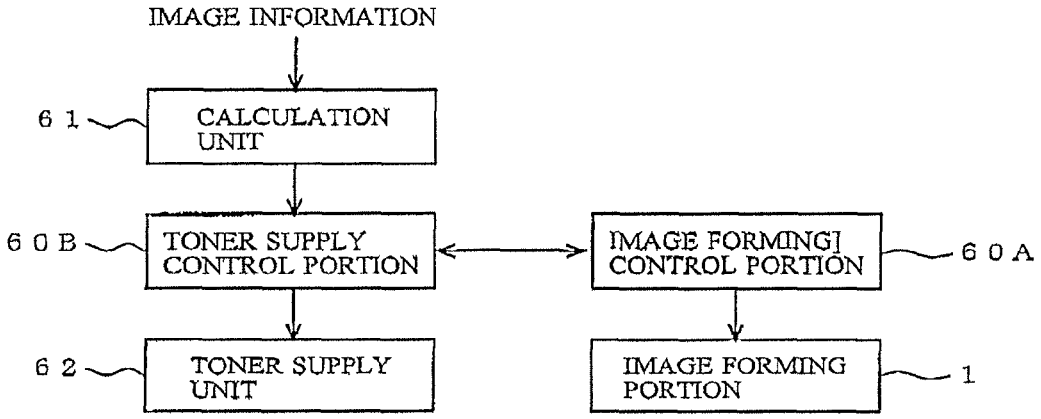
FIG. 5 A block diagram of toner supply control.

In the development device 2 configured as described above, for example, the toner concentration is controlled as follows. FIG. 5 shows a block diagram of the control. An image forming control portion 60A controls the image formation conditions and image formation timing on the image forming portion 1. A calculation unit 61 calculates, based on image information transmitted from a PC or the like connected to the image forming device, the amount of toner consumed in the image formation. A toner supply control portion 60B determines, from operation information such as the transport speed and the image formation rate of the developer in the development device 2 transmitted from the image forming control portion 60A and the toner consumption amount transmitted from the calculation unit 61, the amount of toner supplied from the toner hopper 5 to the development device 2 and the supply timing, and thereby controls the operation of a toner supply unit 62. The image forming control portion 60A and the toner supply control portion 60B exchange information on a time (hereinafter simply referred to as a "supply toner transport time") when the toner supplied is transported to an imaginary region and on an image formation time (development time). As the toner supply unit 62, for example, there is a transport screw provided in the toner hopper; the amount of toner supplied from the toner hopper 5 to the development device 2 and the supply timing are adjusted by rotating or stopping the transport screw and controlling the rate of the rotation as necessary.

Figure 6:
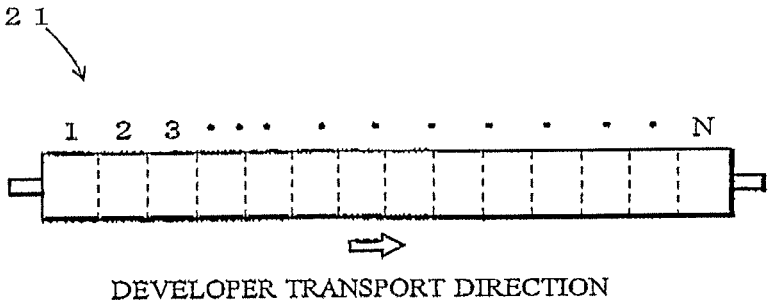
FIG. 6 A diagram showing N imaginary regions provided at regular intervals in the direction of the rotation shaft of a development roller.
Figure 7:
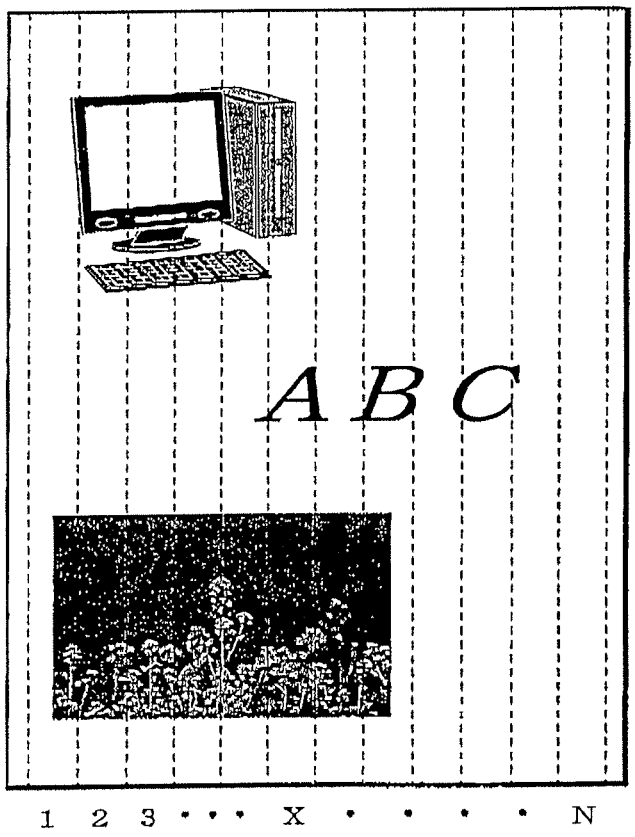
FIG. 7 An example of image formation.
Figure 8:
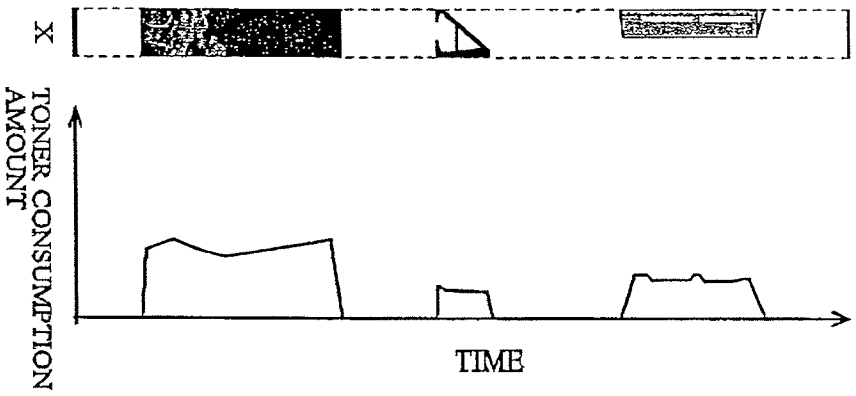
FIG. 8 A diagram showing that the amount of toner consumed in an imaginary region "X" varies with time.
Figure 9:
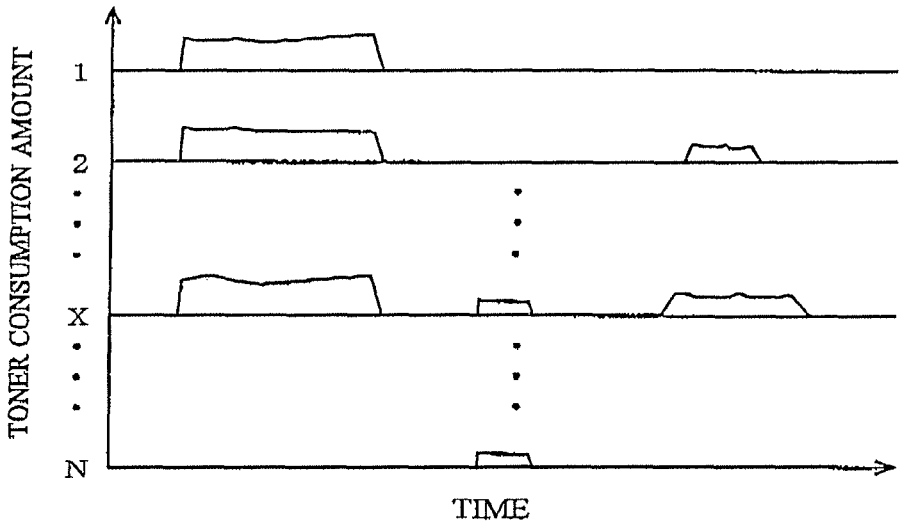
FIG. 9 A diagram showing that the amount of toner consumed in each of imaginary regions "1" to "N" varies with time.

The calculation of the amount of toner consumed in the image formation by the calculation unit 61 is, for example, as shown in FIG. 6, performed for each of N imaginary regions spaced regularly in the direction of the rotation shaft of the development roller 21. For example, when an image shown in FIG. 7 is formed, the image is divided into N pieces in a scanning direction according to the N imaginary regions, and the amount of toner consumed is individually calculated. FIG. 8 shows that the amount of toner consumed in an imaginary region "X" varies with time. FIG. 9 shows that the amount of toner consumed in each of the imaginary regions "1" to "N" with the assumption that the vertical axis is the amount of toner consumed and the horizontal axis is time varies with time.

On the other hand, the time in which the toner supplied from the opening portion 273 of the development device 2 is transported to each imaginary region is, as is understood from FIG. 6, is the longest for the imaginary region "1" on the upstream side in the developer transport direction, and is the shortest for the imaginary region "N" on the downstream side in the developer transport direction. Hence, in the present invention, in order for the toner from the toner hopper 5 to be appropriately supplied when the toner is consumed in each imaginary region, the toner is supplied to the development device 2 earlier by a time in which the toner supplied from the toner hopper 5 is transported to each imaginary region than a time when an image is formed in a predetermined stage, more specifically, a time when the toner is consumed by developing, with the toner, the latent image in each imaginary region.

Figure 10:
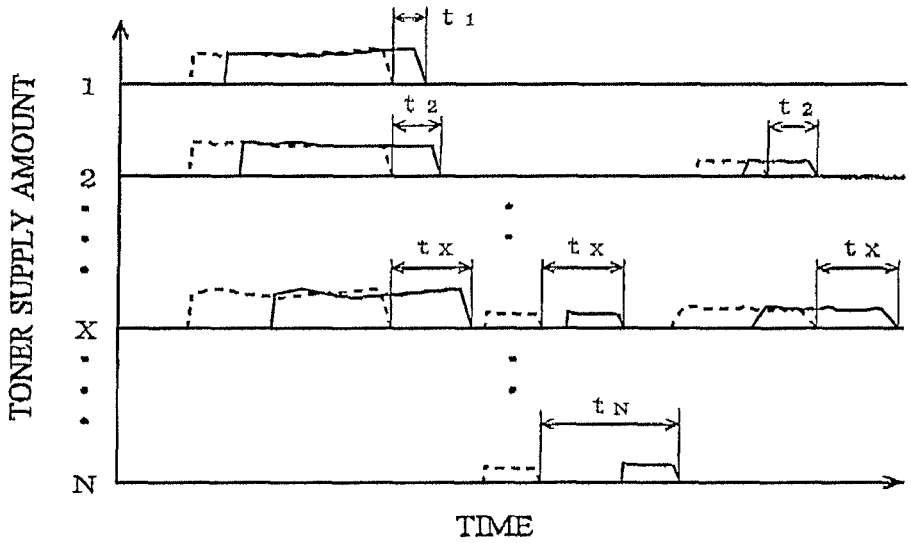
FIG. 10 A diagram showing a toner supply amount and a supply time in each imaginary region.

Specifically, as indicated by a solid line in FIG. 10, in the imaginary region "1", the toner is supplied a $t_1$ time earlier than the time when the toner is consumed (indicated by a broken line in FIG. 10). In the imaginary regions "2" . . . "X" . . . and "N", the toner is likewise supplied earlier by a $t_2$ time, a $t_X$ time and a $t_N$ time, respectively. $t_1, t_2, \ldots, t_X, \ldots$ and $t_N$ are proportional to the distance from the opening portion 273 of the development device 2 to each imaginary region, and a relationship of $t_1<t_2< \ldots <t_X< \ldots <t_N$ holds true.

In the embodiment of the present application, the following conditions are set. In the description of FIG. 10, for ease of the description, the scale of the display length of $t_1$ to $t_N$ is reduced as compared with the actual scale.

The total length of the first transport member 25: 250 mm

The transport speed in the first transport member 25 and the second transport member 26: 25 to 50 mm/second The time in which the developer is circulated once through the developer bath of the development device 2: 10 to 20 seconds The number of N divisions: 10 to 20

$t_1$: 5 to 10 seconds $t_N$: 10 to 20 seconds

The image formation time for one sheet (A4 horizontal size): 1 to 2 seconds

Figure 11:
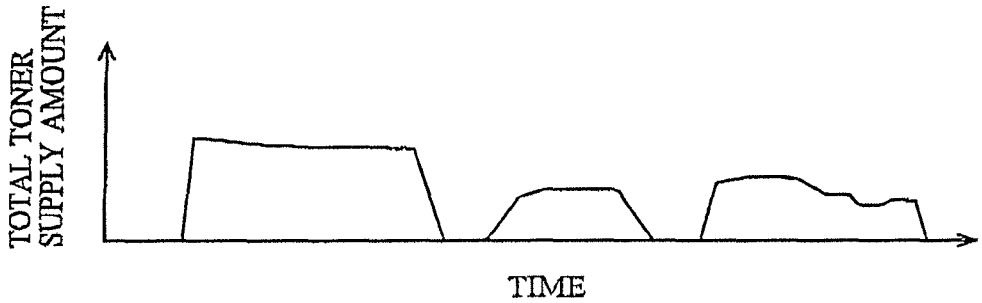
FIG. 11 A diagram showing that the amount of toner supplied from a toner hopper to development device varies with time.

As shown in FIG. 11, the total amount of toner supplied to the individual imaginary regions shown in FIG. 10 is supplied from the toner hopper to the development device 2. This prevents the reduction in image density caused by reduction of the toner concentration and the dispersion of the toner caused by the supply of excessive toner.

Figure 12:
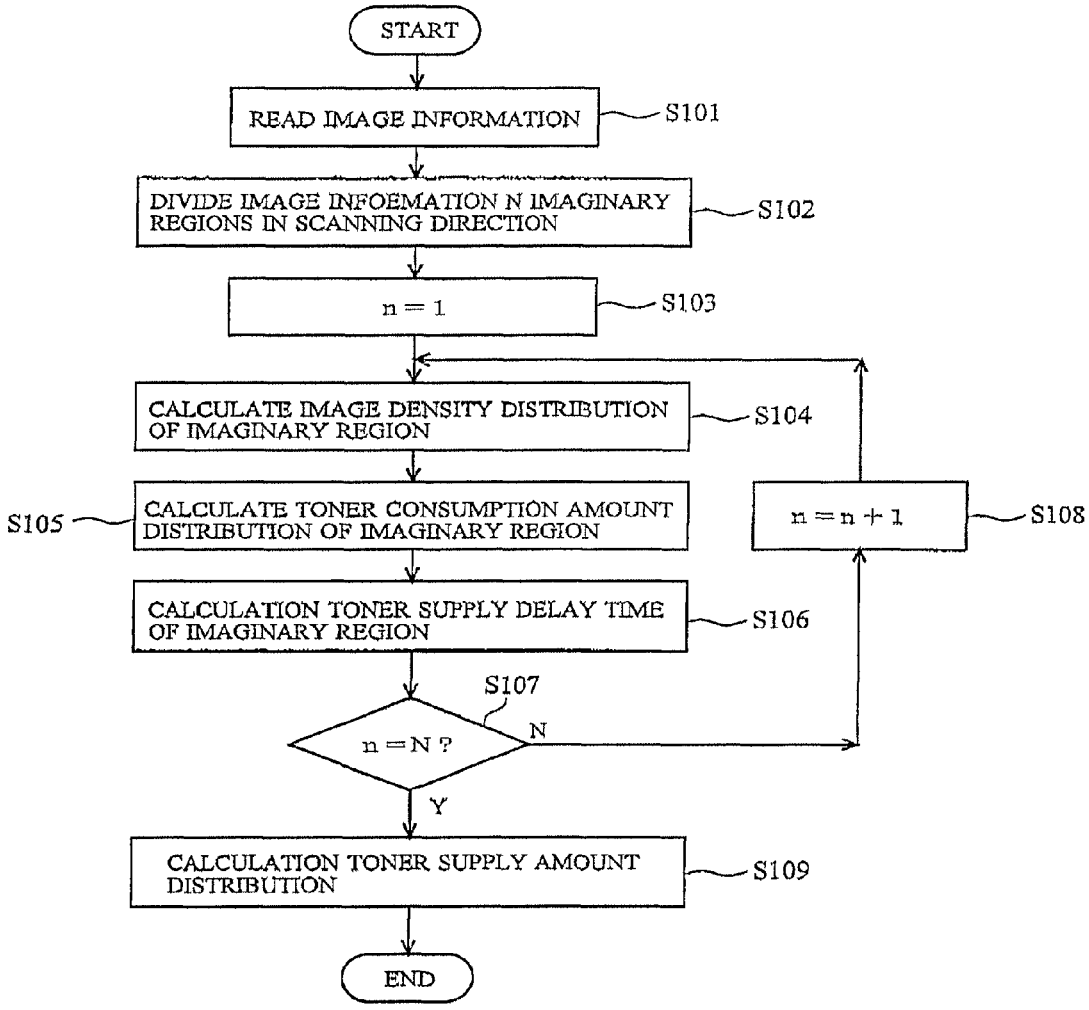
FIG. 12 A flowchart of toner supply control in a first embodiment.

FIG. 12 shows a flowchart controlled by the toner supply control portion 60B in the first embodiment described above. First, the image information is read (step S101), and, in the calculation unit 61, the image information is divided into the N regions in the scanning direction according to the number of imaginary regions divided (step S102). Then, the distribution of image density in a vertical scanning direction in the first region is calculated (step S104), and, based on this, the distribution of the toner consumption amount in the vertical scanning direction in the first region is calculated (step S105). As described with reference to FIG. 10, a "toner supply delay time" needed to transport the toner supplied from the toner hopper 5 to the first imaginary region is calculated. A series of operations described above are likewise operated in the second to Nth regions (steps S104 to S108). Then, as shown in FIG. 11, the total toner supply amount distribution in which the toner supply delay time in the first to Nth regions is adjusted is calculated (step S109).

Figure 13:
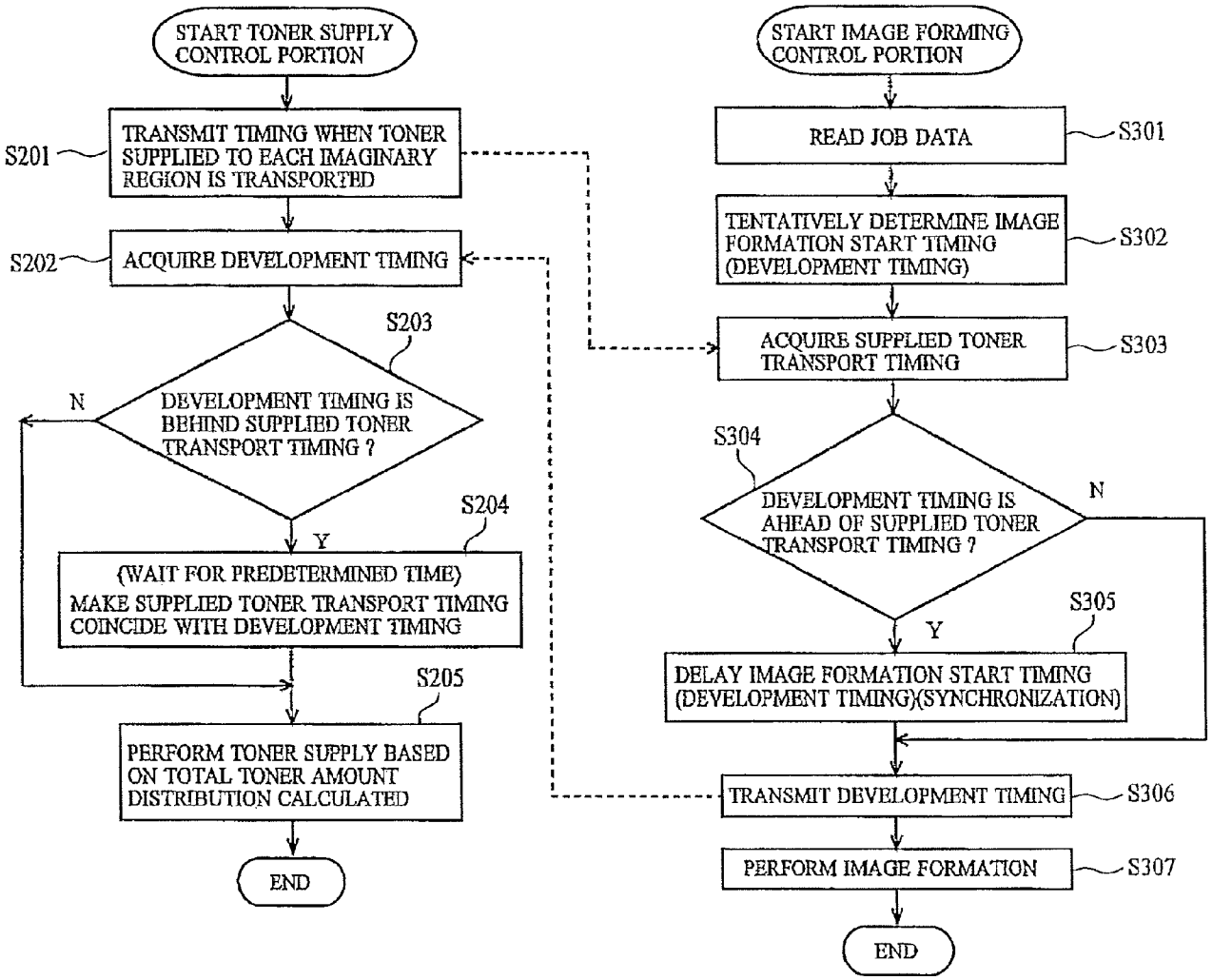
FIG. 13 A flowchart of toner supply control performed after FIG. 12.

FIG. 13 shows a flowchart performed after FIG. 12. In the toner supply control portion 60B, a supply toner transport time based on the total toner supply amount distribution calculated in the flowchart of FIG. 12 is transmitted to the image forming control portion 60A (step S201).

In the image forming control portion 60A, job data is read (step S301), and, based on the read information, an image formation start time is tentatively determined (step S302). The job data includes the image information, settings such as for color/monochrome and double-sided/single-sided and print setting information on sheet sizes. Then, in the tentative decision, with consideration given to the print setting information, a warm-up state of the fixing roller pair 43 in the image forming device and a working state of the image forming portion 1, a time when the image formation is started the earliest is estimated, and this is set at a tentatively determined value. The image formation start time is determined, and thus a development time when the toner is consumed in an imaginary region by the development device 2, which is included in the series of operations in the image formation, is also determined.

Then, the supply toner transport time from the toner supply control portion 60B is acquired (step S303), and is compared with the development time calculated from the image formation start time tentatively determined in step S302 (step S304).

If the development time is ahead of the supply toner transport time (yes in step S304), the tentatively determined image formation start time is changed to a time obtained by delaying it by a predetermined time, and the development time and the supply toner transport time are synchronized with each other (step S305).

Then, the development time based on the changed image formation start time is transmitted to the toner supply control portion 60B (step S306).

For example, if the fixing roller pair is not in a state where the image formation can be immediately performed, and the image formation start time is delayed, and the development time is not ahead of the supply toner transport time (no in step S304), the image formation start time tentatively determined in step S302 is adopted, and the development time based on this is transmitted to the toner supply control portion 60B (step S306). In step S307, the image formation is performed based on the determined image formation start time.

In the toner supply control portion 60B, the development time is acquired (step S202), and the acquired development time is compared with the supply toner transport time to each imaginary region, with the result that, if the development time is behind the supply toner transport time (yes in step S203), the time when the toner is supplied is delayed, and the supply toner transport time is synchronized with the development time (step S204).

On the other hand, if the development time is not behind the supply toner transport time, that is, if the development time is in synchronization with the supply toner transport time (no in step S203), the toner supply based on the calculated total toner supply amount distribution is immediately started (step S205).

In the first embodiment, as described with reference to FIGS. 12 and 13, the timing of the image formation start time or the time when the toner supply is started is adjusted to synchronize them, and thus the toner is supplied to the development device 2 earlier by a time in which the toner supplied from the toner storage portion is transported to each imaginary region.

In this way, it is possible to calculate the amount of toner consumed in the future and previously supply the toner corresponding to the consumption amount, and thus it is possible to prevent the reduction in the toner concentration on the development roller 21 and the reduction in image density caused by reduction of the toner concentration. Since the region where the toner concentration is increased in the imaginary region of the development roller 21 can be limited to only the imaginary region where the toner will be consumed in the future on the development roller 21, as compared with the case where the setting value of the toner concentration is set high over all the regions within the development device 2, the region where the toner concentration is high is limited, with the result that it is possible to reduce, over the entire development device 2, toner dispersion caused by the high toner concentration.

Even if the toner is transported to the second transport member 26 and is supplied onto the developer, in about a time period during which the toner is circulated once or twice within the development device 2, the developer is not completely mixed with the preceding and subsequent regions, and the toner concentration distribution corresponding to the amount of toner supplied is maintained. In other words, when the toner is supplied based on the calculated total toner supply amount distribution, even if regions where the toner concentration is high are locally present, with the toner concentration distribution maintained, the developer is transported by the second transport member 26 and the first transport member 25, and the developer is fed to the imaginary region of the development roller 21.

Second Embodiment

Figure 14:
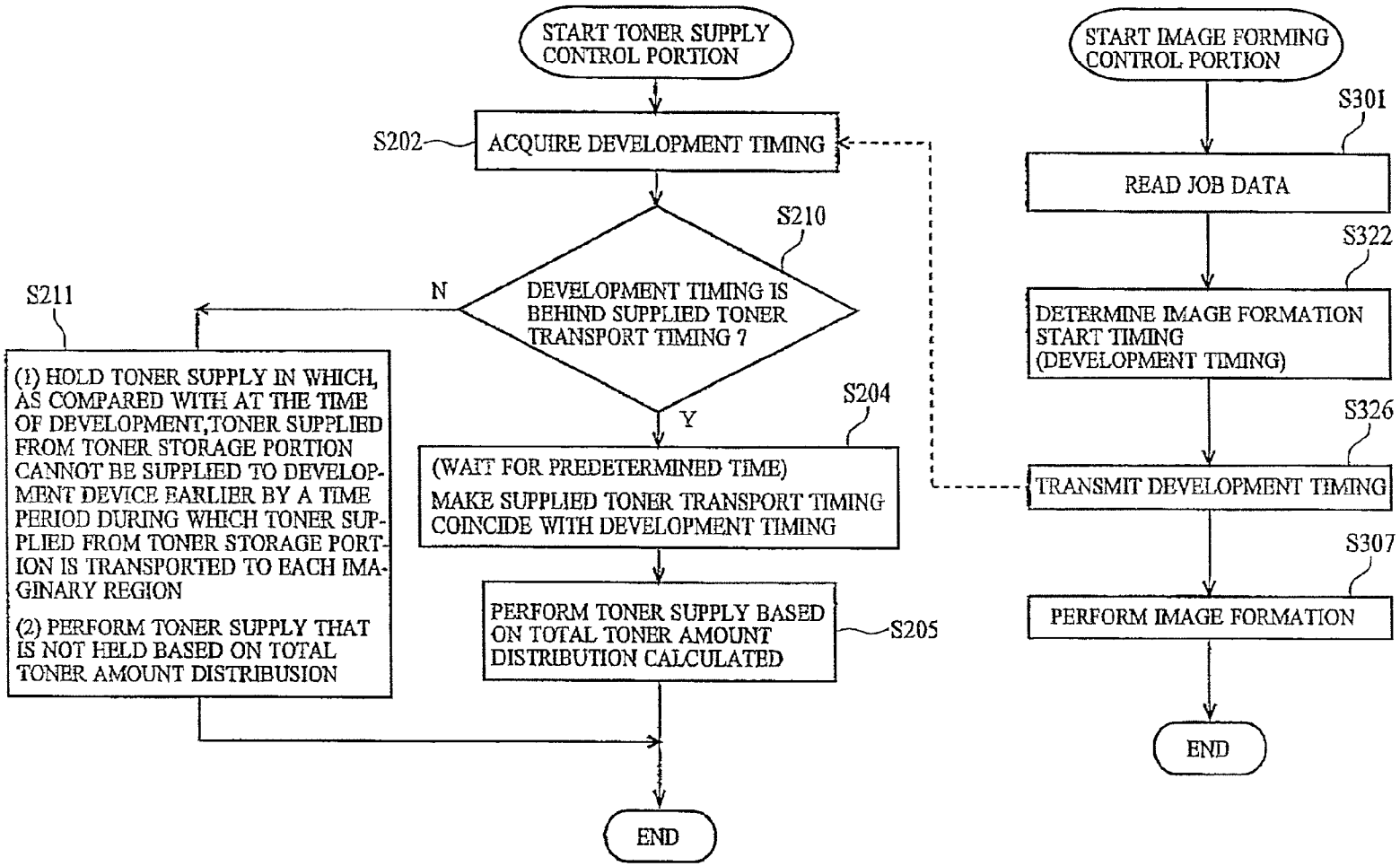
FIG. 14 A flowchart of toner supply control in a second embodiment.

FIG. 14 is a diagram sowing a second embodiment. In the first embodiment, the timing control is performed such that a high priority is given to the control on the toner supply, and that the image formation start time is delayed as necessary, and thus the following state is realized: "The same amount of toner as the amount of toner consumed in each imaginary region at the time of development, calculated by the calculation unit, is supplied to the development device earlier by a time in which the toner supplied from the toner storage portion is transported to each imaginary region than at the time of development."

By contrast, in the second embodiment, a higher priority is given to the control on the image formation than the control on the toner supply, the processing for delaying the image formation start time is not performed and toner supply with timing at which the toner cannot be supplied to the development device earlier by a time in which the toner supplied from the toner storage portion is transported to each imaginary region than at the time of development is suspended.

As in the first embodiment, FIGS. 1 to 12 also apply to the second embodiment, and thus their description will not be repeated. In FIG. 14, the processing other than the symbols S210, S211, S323 and S326 is the same as in FIG. 13. The same configurations are identified with the same symbols, and their description will not be repeated.

In step S322 of FIG. 14, as with the processing in step S302 of FIG. 13, with consideration given to the print setting information included in the job data, and the working state of the image forming device, the image forming control portion 60A estimates the time when the image formation can be started the earliest. In the second embodiment, unlike the first embodiment, since consideration is not given to the toner supply time calculated by the toner supply control portion 60B, the image formation start time estimated by the image forming control portion 60A is determined to be the image formation start time without being changed, and, in the subsequent step S326, the development time calculated based on this is transmitted to the toner supply control portion 60B.

In step S210 of FIG. 14, if the development time is not behind the supply toner transport time (no in step S210), that is, if the toner supply with timing at which the toner cannot be supplied to the development device earlier by a time in which the toner supplied from the toner storage portion is transported to each imaginary region than at the time of development is included, the toner supply is suspended, and the toner supply is performed based on the total toner amount distribution other than the suspended toner amount (step S211).

Figure 15A:
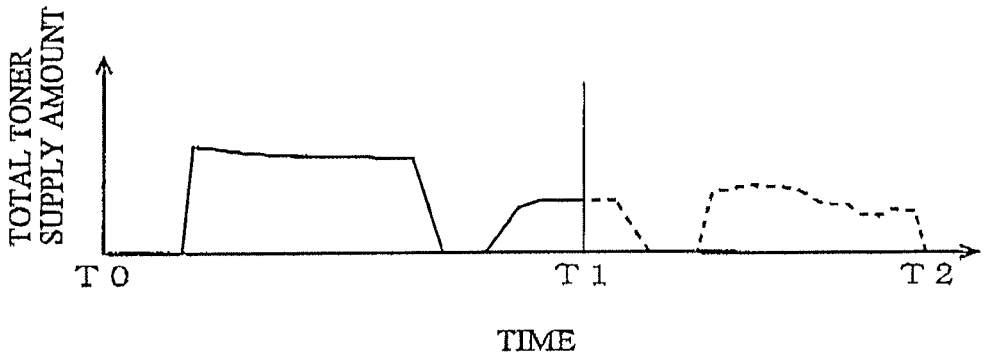
FIG. 15A A diagram for illustrating the suspension of the toner supply.

FIG. 15A is a diagram corresponding to FIG. 11; the suspension of the toner supply in step S211 will be described based on FIG. 15A.

In FIG. 15A, a time T1 corresponds to the development time; in the total toner supply amount distribution on the right side with respect to the time T1 (from the time T1 to a time T2), even if the toner is immediately supplied, it is impossible to transport the developer where the toner is supplied to the imaginary region in time for the development device.

For example, when the development time for starting the development for one page is determined to be after the time T1, even if the toner is immediately supplied to the opening portion 273, which is the toner supply position, whether or not the developer containing the toner supplied in the toner supply position reaches each imaginary region after the time T1 depends on the transport speed in the first transport member 25 and the second transport member 26 and the distance to each imaginary region.

For example, when it is assumed that the $t_1$ time, the $t_2$ time, the $t_3$ time, the $t_4$ time and the $t_5$ time are 6, 7, 8, 9 and 10 seconds, the development time for one page is started in 8 seconds from now and it continues until 10 seconds, even if the toner is immediately supplied to the opening portion 273, which is the toner supply position, it is possible to supply the toner to the imaginary regions "1" to "3" corresponding to the $t_1$ time, the $t_2$ time and the $t_3$ time with timing in time for all the development times whereas it is impossible to supply the toner to the imaginary region "5" with timing in time for all the development times. For the imaginary region "4", the toner supply can be performed in time for the latter part of the one page whereas it is impossible to supply the toner with timing in time for the first half of the development time.

In step S211 of FIG. 14, control is performed such that the toner supply at the time T1 to the time T2 which cannot be performed is suspended. Although the toner supply is suspended, and thus the toner concentration of the developer stored in the development device 2 is temporarily reduced, the toner concentration is controlled to a predetermined toner concentration by performing the toner supply according to the output of the concentration detection sensor 70.

(Variation)

Figure 15B:
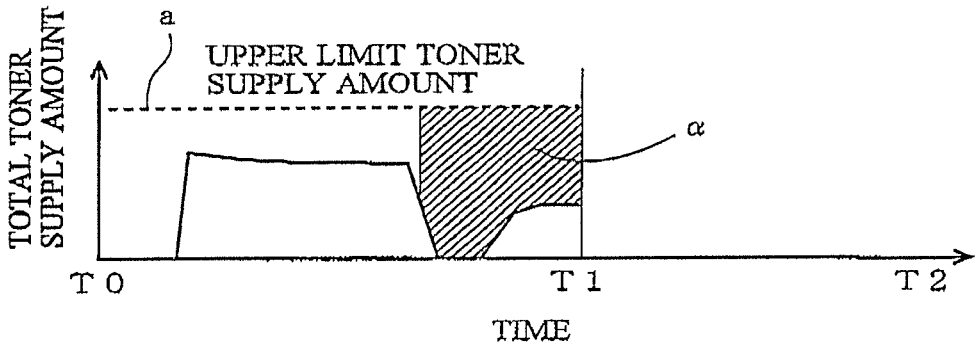
FIG. 15B A diagram for illustrating the performance of toner supply suspended in a variation.

A variation will be described with reference to FIG. 15B. In the variation, the toner supply suspended is performed again. In FIG. 15B, a line indicated by a symbol "a" represents an upper limit toner supply amount. The upper limit toner supply amount represents the upper limit of the toner supply amount per unit time; the upper limit value of the toner supply amount is previously determined based on the agitation function of the development device and the charging function of the developer. In FIG. 15B, the suspended toner supply amount at the time T1 to the time T2 is controlled so as not to exceed the upper limit toner supply amount, and is allocated to times after the time T1. In the example of FIG. 15B, a region indicated by a represents the allocated toner amount, and the amount is equal to the toner supply amount suspended.

Third Embodiment

Figure 16:
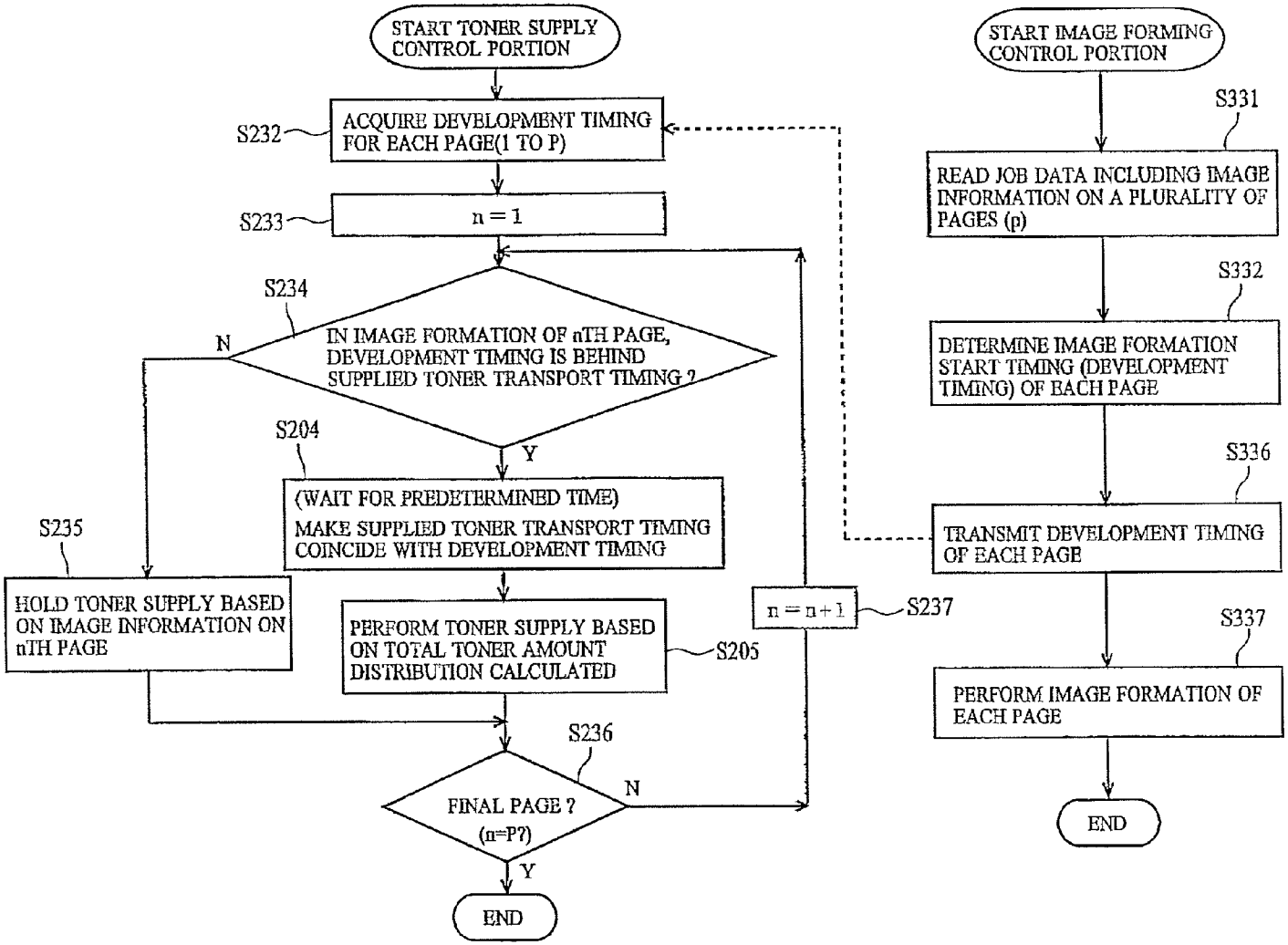
FIG. 16 A flowchart of toner supply control in a third embodiment.

In a third embodiment, the allocation of the image formation is performed for each page. FIG. 16 is a diagram showing the third embodiment. In the second embodiment, the toner supply with timing at which the toner cannot be supplied to the development device earlier by the time in which the toner supplied from the toner storage portion is transported to each imaginary region than at the time of development is suspended. In the third embodiment, such suspension is performed for each page.

In the image forming control portion 60A, job data including image information on a plurality of pages (p pages) is read (step S331), and, based on the read information, the image formation start time is determined for each of the first to pth pages (step S332). The image formation start time is determined, and thus the development time when the toner is consumed in the imaginary region by the development device 2, which is included in the series of operations of the image formation, is also calculated. Then, based on the determined image formation start time, the calculated development time for each page is transmitted to the toner supply control portion 60B (step S336). In step S337, based on the determined image formation start time, the image formation for each page is performed.

In the toner supply control portion 60B, the development time for each page is acquired (step S232), and the development time acquired for each page (for each image formation operation) is compared with the supply toner transport time to each imaginary region, and, if the development time is behind the supply toner transport time (yes in step S234), the time when the toner is supplied is delayed, and the supply toner transport time is synchronized with the development time (steps S204 and S205).

On the other hand, if the development time for the nth page is not behind the supply toner transport time (no in step S234), the toner supply based on the image information on the nth page is suspended. The series of control steps described above is likewise repeated from the first page to the final page.

What is claimed is:

1. An image forming device that develops, with a toner, an electrostatic latent image formed on an image carrying member based on image information and that transfers a developed toner image to a recording member to form the image on the recording member, the mage forming device comprising:

a developer carrying member that carries a developer containing the toner and a carrier on a surface, and that rotates and transports the developer to a position opposite the image carrying member to develop, with the toner, the electrostatic latent image formed on the image carrying member;

a development device that includes the developer carrying member and a developer transport unit which transports, while agitating and mixing the developer, the developer to feed the developer to the developer carrying member;

a toner storage portion that stores the toner which is supplied to a transport region of developer transport unit of the development device;

a calculation unit that calculates, per image formation operation, from the image information, an amount of the toner consumed for the development of the electrostatic latent image for each of a plurality of imaginary regions divided at predetermined intervals in a direction of a rotation shaft of the developer carrying member; and a toner supply control portion that controls an amount of the toner supplied from the toner storage portion to the development device and supply timing, wherein the toner supply control portion supplies, to the development device, the same amount of the toner as the amount of the toner consumed in each of the imaginary regions when the development is performed that is calculated by the calculation unit, earlier by a time in which the toner supplied from the toner storage portion is transported to each of imaginary regions than at the time of the development of the electrostatic latent image in each imaginary region.

2. The image forming device according to claim 1, further comprising:

an image forming control portion that controls timing at which the image formation is performed, wherein the image forming control portion determines a time when the development is performed with the toner in each imaginary region, and if the image forming control portion determines that the time when the development is performed with the toner in each imaginary region is ahead of the time when the toner supplied from the toner storage portion is transported to each imaginary region, then the image forming control portion delays the time when the image formation is started to make the time when the development is performed with the toner equal to the time when the toner supplied from the toner storage portion is transported to each imaginary region.

3. The image forming device according to claim 1, further comprising:

an image forming control portion that controls timing at which the image formation is performed, wherein the toner supply control portion is configured to acquire a time when the development is performed with the toner in each imaginary region, and if the time when the development is performed is not behind the time when the toner supplied from the toner storage portion is transported to each imaginary region, the toner supply control portion suspends the supply of toner that cannot be supplied to the development device earlier than the time when the development is performed.

4. The image forming device according to claim 3, wherein the toner supply control portion is configured to:

acquire the time when the development is performed per image formation operation when the image formation is continuously performed on a plurality of recording members based on the image information;

determine per image formation operation whether the time when the development is performed is not behind the time when the toner supplied from the toner storage portion is transported to each imaginary region; and if the time when the development is performed is not behind the time when the toner is supplied, the toner supply control portion suspends the supply of toner for each image formation operation that cannot be supplied to the development device earlier than the corresponding time when the development is performed.

5. The image forming device according to claim 3, wherein the toner supply control portion is configured to perform the suspended toner supply so as not to exceed a previously set upper limit supply amount per unit time.

* * * * *